US009786974B2

(12) United States Patent
Shiroyama et al.

(10) Patent No.: US 9,786,974 B2
(45) Date of Patent: Oct. 10, 2017

(54) TUNABLE BAND-PASS FILTER

(71) Applicant: NEC Corporation, Tokyo (JP)

(72) Inventors: Norihisa Shiroyama, Tokyo (JP); Sumio Ueda, Tokyo (JP); Kiyotake Sasaki, Tokyo (JP); Takahiro Miyamoto, Tokyo (JP)

(73) Assignee: NEC Corporation, Tokyo (JP)

( * ) Notice: Subject to any disclaimer, the term of this patent is extended or adjusted under 35 U.S.C. 154(b) by 151 days.

(21) Appl. No.: 14/436,009

(22) PCT Filed: Oct. 18, 2013

(86) PCT No.: PCT/JP2013/006181

§ 371 (c)(1),
(2) Date: Apr. 15, 2015

(87) PCT Pub. No.: WO2014/064911

PCT Pub. Date: May 1, 2014

(65) Prior Publication Data

US 2015/0280298 A1 Oct. 1, 2015

(30) Foreign Application Priority Data

Oct. 23, 2012 (JP) ..... 2012-233659

(51) Int. Cl.
*H01P 1/205* (2006.01)
*H01P 7/04* (2006.01)
(Continued)

(52) U.S. Cl.
CPC ..... *H01P 1/2053* (2013.01); *H01P 1/205* (2013.01); *H01P 1/207* (2013.01); *H01P 1/2056* (2013.01);
(Continued)

(58) Field of Classification Search
CPC ..... H01P 1/207; H01P 1/2056; H01P 1/2084; H01P 1/2053; H01P 1/205; H01P 7/04; H01P 7/06
(Continued)

(56) References Cited

U.S. PATENT DOCUMENTS 4,459,570 A * 7/1984 Delaballe ..... H01P 7/10 333/202
2005/0040916 A1 2/2005 Park et al.
(Continued)

FOREIGN PATENT DOCUMENTS

CN 1585188 A 2/2005
CN 101645526 A 2/2010
(Continued)

OTHER PUBLICATIONS

International Search Report, Corresponding to PCT/JP2013/006181, dated Jan. 14, 2014, 2 pages.
(Continued)

*Primary Examiner* — Benny Lee
*Assistant Examiner* — Hafizur Rahman
(74) *Attorney, Agent, or Firm* — Wilmer Cutler Pickering Hale and Dorr LLP

(57) ABSTRACT

The present invention comprises: a conductive chassis having a cavity resonator; a conductive cover to cover the cavity resonator; a resonant element arranged in the cavity resonator, one end of the resonant element being connected with the chassis and the other end being open end; and a movable conductor arranged in a space between the open end of the resonant element and the conductive cover. As a result, a tunable band-pass filter which is inexpensive and of a simple structure and which can change a resonance frequency of a cavity resonator and the coupling amount between cavity resonators easily is realized.

16 Claims, 8 Drawing Sheets

(51) Int. Cl.
*H01P 1/207* (2006.01)
*H01P 7/06* (2006.01)
*H01P 1/208* (2006.01)

(52) U.S. Cl.
CPC ..... *H01P 1/2084* (2013.01); *H01P 7/04* (2013.01); *H01P 7/06* (2013.01)

(58) Field of Classification Search
USPC ..... 333/202
See application file for complete search history.

(56) References Cited

U.S. PATENT DOCUMENTS

| | | | |
|---|---|---|---|
| 2007/0247262 | A1 | 10/2007 | Park et al. |
| 2009/0058563 | A1 | 3/2009 | Seo et al. |
| 2009/0153271 | A1 | 6/2009 | Park et al. |
| 2009/0237185 | A1 | 9/2009 | Raty |
| 2011/0133862 | A1 | 6/2011 | Chun et al. |
| 2012/0119850 | A1 | 5/2012 | Pari et al. |

FOREIGN PATENT DOCUMENTS

| | | | |
|---|---|---|---|
| JP | S59-121903 | U | 8/1984 |
| JP | 07-131217 | A | 5/1995 |
| JP | 07-263926 | A | 10/1995 |
| JP | 09-172304 | A | 6/1997 |
| JP | 2001-257511 | A | 9/2001 |
| JP | 2003-318612 | A | 11/2003 |
| JP | 2011-142460 | A | 7/2011 |
| WO | WO-2006-075439 | A1 | 7/2006 |

OTHER PUBLICATIONS

Chinese Office Action issued by the State Intellectual Property Office of the People's Republic of China for Application No. 201380055643.X dated Jun. 1, 2016 (18 pages).
Extended European Search Report issued by the European Patent Office for Application No. 13848804.4 dated May 10, 2016 (10 pages).
Japanese Office Action issued in corresponding Japanese Application No. 2012-233659, dated May 31, 2016, 10 pages.

* cited by examiner

TUNABLE BAND-PASS FILTER

CROSS-REFERENCE TO RELATED APPLICATIONS

The present application is a national stage application of International Application No. PCT/JP2013/006181 entitled "Turnable Band-Pass Filter," filed on Oct. 18, 2013, which claims the benefit of priority from Japanese Patent Application No. JP2012-233659, filed on Oct. 23, 2012, the disclosures of which are incorporated herein in their entirety by reference thereto.

TECHNICAL FIELD

The present invention relates to a band-pass filter used in a microwave and a millimeter wave, and, more particularly, to a tunable band-pass filter which can vary a resonance frequency.

BACKGROUND ART

In a radio communication system that performs transmission and reception using a microwave or a millimeter wave band, a band-pass filter is used to make only a signal of a desired frequency band pass, and to remove a signal of an unnecessary bandwidth. When a band-pass filter is used at a plurality of center frequencies, there is a technological case described in patent literature 1. In patent literature 1, there is disclosed a technology in which, in the metal housing of a semi-coaxial band-pass filter, a dielectric having a movable structure is provided and a resonance frequency of a resonator is made to be changed by moving this.

CITATION LIST

Patent Literature

[PTL 1] International Publication No. WO 2006/075439

SUMMARY OF INVENTION

Technical Problem

However, in the technology described in patent literature 1, in order to change a resonance frequency within a suitable range, a special dielectric material, a dielectric material having a high permittivity such as a compound of a rare-earth barium titanate system, for example, is required, and, as a result, increase of cost is caused.

Further, when forming a band-pass filter, it needs to be of a system in which a dielectric member is used in each stage of a cavity semi-coaxial resonator of a plurality of stages and these plurality of dielectric members are moved simultaneously. At that time, there is a problem that the structure becomes complicated because a holding member which joins a dielectric member and a movable member connected with the dielectric member is needed due to a difference of material between them.

The present invention has been made in view of the above-mentioned subject, and its object is to provide a tunable band-pass filter which is of low cost and of a simple structure, and which can change a resonance frequency of a resonator and a coupling amount (or, a coupling coefficient) between resonators easily.

Solution to Problem

A tunable band-pass filter of the present invention comprises: a conductive chassis having a cavity resonator; a conductive cover to cover said cavity resonator; a resonant element arranged in said cavity resonator, one end of said resonant element being connected with said chassis and an other end being open end; and a movable conductor arranged in a space between said open end of said resonant element and said conductive cover.

Advantageous Effects of Invention

According to a tunable band-pass filter of the present invention, it becomes possible to provide a tunable band-pass filter which is of low cost and of a simple structure, and which can change a resonance frequency of a resonator and a coupling amount between resonators easily.

DESCRIPTION OF EMBODIMENTS

Hereinafter, an exemplary embodiment of the present invention will be described in detail with reference to a drawing. However, although limitation that is technically preferred to carry out the present invention is being imposed to exemplary embodiments described below, the scope of the invention is not limited to the followings.

First Exemplary Embodiment

Figure 1A:
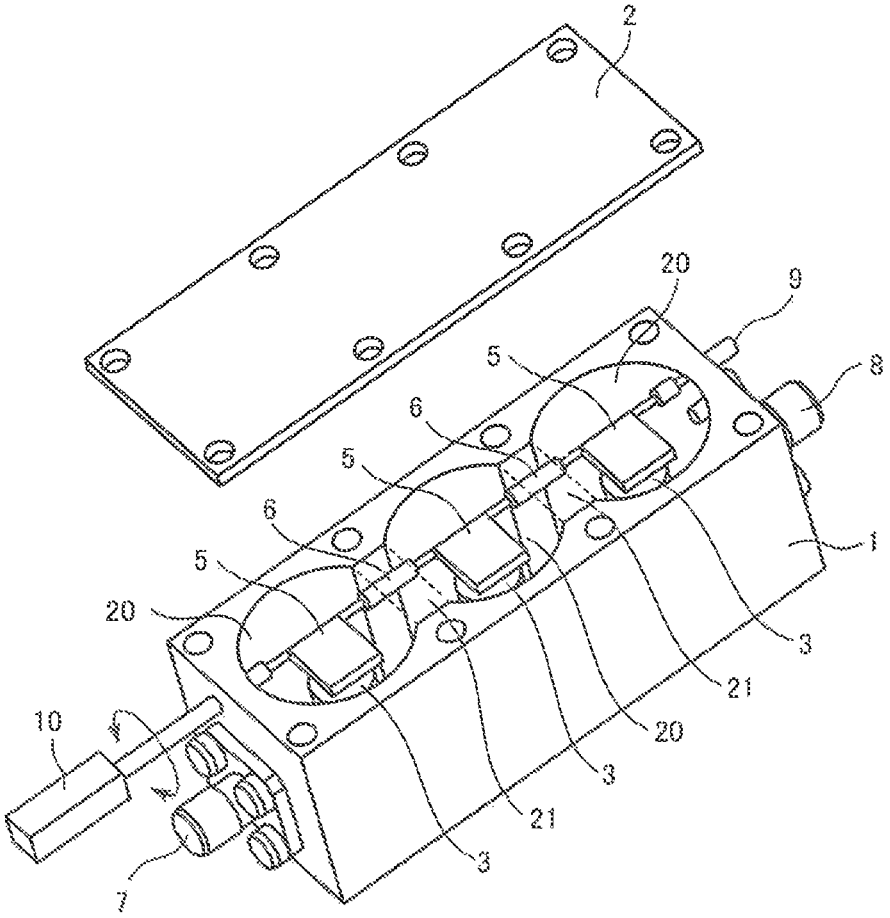
FIG. 1A is a perspective view showing a structure of a tunable band-pass filter of a first exemplary embodiment of the present invention.
Figure 1B:
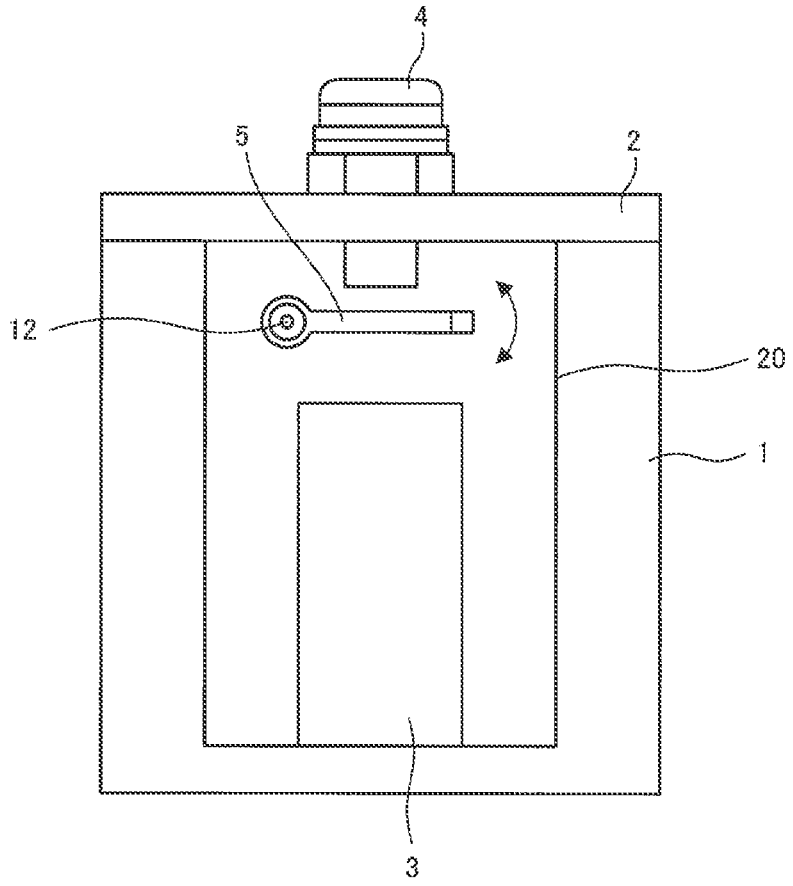
FIG. 1B is a sectional view showing a structure of a tunable band-pass filter of the first exemplary embodiment of the present invention.

A tunable band-pass filter of the first exemplary embodiment of the present invention will be described in detail using FIG. 1A and FIG. 1B. FIG. 1A is a perspective view showing a structure of the first exemplary embodiment of the present invention. In FIG. 1A, there is indicated a band-pass filter including pieces of cavity resonator 20 of three stages. FIG. 1B indicates a sectional view of one piece of cavity resonator 20 among the pieces of cavity resonator 20 of three stages shown in FIG. 1A.

The cavity resonator 20 is formed by a combination of a conductive chassis 1 and a conductive cover 2. Although the cavity resonator 20 is of a cylindrical shape in FIG. 1A, it is not limited to a cylindrical shape, and it may be of another shape such as a prismatic shape. A window 21 of a structure made by cutting out a part of said cylindrical shape connects between each cavity resonator. The shape of the window 21 is not limited to the shape shown in FIG. 1A, and it may be of a shape besides this shape such as a cylinder, and the width of the cutout may be made to be about the same as the diameter of the cylinder of the cavity resonator 20.

A resonant element 3 is installed in the cavity resonator 20, and its one end is connected to the conductive chassis 1 and the other end which is in the side facing the conductive cover 2 is open. As a shape of the resonant element 3, a tabular shape, a prism or a column is possible, but not limited to these. For example, a shape having a bend of an L letterform is also possible. As material of the resonant element 3, a conductor or a dielectric is possible.

There are provided, in the cavity resonators of the both ends among the three pieces of cavity resonator 20 which form a band-pass filter, an input terminal 7 for inputting a radio wave from outside and exciting said resonant element 3 and an output terminal 8 for outputting a radio wave which has passed said plurality of pieces of resonant element 3 outside the chassis. In FIG. 1A, although a three-stage band-pass filter having three pieces of cavity resonator 20 is being disclosed, the number of pieces of cavity resonator 20 is not limited. Furthermore, the input terminal 7 and the output terminal 8 are ones which have been defined for convenience of description of operation, and thus it is possible to input a radio wave from the output terminal 8, and take out a radio wave from the input terminal 7.

There is arranged a conductor 5 made of a conductive member between each piece of resonant element 3 and the conductive cover 2. An inexpensive metal such as copper and aluminum is possible as the material of the conductor 5. The conductor 5 is arranged for each piece of cavity resonator 20, and neighboring pieces of conductor 5 are connected by a non-conductive member 6. As the non-conductive member 6, an inexpensive member such as ceramic and resin is possible. In order to connect the non-conductive member 6 and the conductor 5, a connection member (no code attached in FIG. 1A) may be provided between the non-conductive member 6 and the conductor 5. Although the material of this connection member is optional, it is possible to use an inexpensive member of metal, ceramic or resin. The conductor 5 may be one having a size and a shape different for each piece of cavity resonator 20.

Among the both ends of the train of pieces of conductor 5 connected by pieces of non-conductive member 6, one end penetrates through the conductive chassis 1 by a support 9, and, in addition, is made to be able to rotate about an axis to make the conductor 5 be movable from outside of the conductive chassis 1 of the band-pass filter. Here, said one end does not need to penetrate. The other end penetrates through the conductive chassis 1, is taken out outside, and is also made to be able to be axis-rotated. As motive power of this axial rotation, a stepping motor 10 or the like whose rotation is controlled by a computer can be used although manual may be acceptable.

FIG. 1B is a diagram showing a sectional structure of one piece of cavity resonator 20 constituting a band-pass filter shown in FIG. 1A. By rotating in the directions indicated by the arrows in this figure about a supporting point 12, the conductor 5 changes the capacity between the resonant element 3 and itself, and changes a resonance frequency. That is, by making the conductor 5 rotate, the capacity is changed by the interval between the conductor 5 and the resonant element 3 changing. In the case of FIG. 1B, a resonance frequency can be lowered along with rotation toward downward direction shown by the arrow in this figure. Here, there is used a frequency adjustment screw 4 to determine a standard resonance frequency of the cavity resonator 20. However, it is not indispensable as a function of a tunable band-pass filter. In FIG. 1A, there is indicated a case where the frequency adjustment screw 4 does not exist.

According to the exemplary embodiment disclosed above, a band-pass filter is inexpensive because the conductor 5 made of metal such as copper and aluminum that is of low cost is used between each resonant element 3 and the conductive cover 2. Furthermore, its structure is simple because the conductor 5 is not a dielectric member and thus is easy to be connected with a moving member, resulting in a holding member that would be necessary to join a dielectric member or the like being unnecessary. That is, as an effect of this exemplary embodiment, it is possible to provide a tunable band-pass filter which is of an inexpensive and of an easy structure, and which can change a resonance frequency of the cavity resonator 20 easily.

Figure 2:
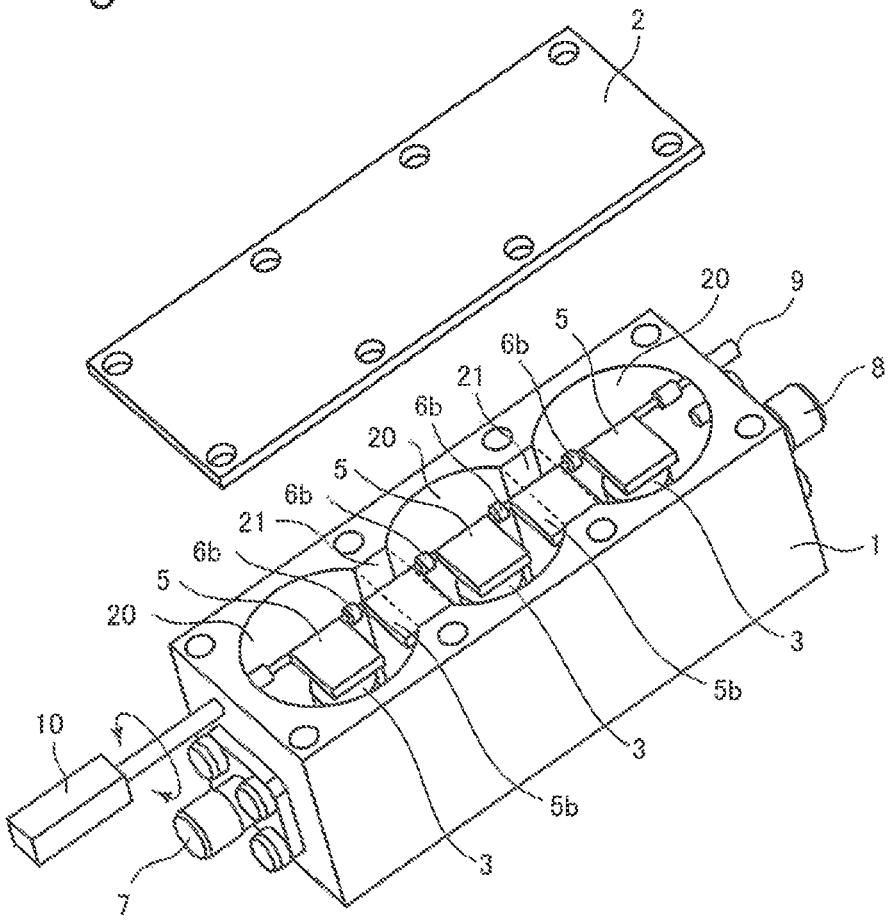
FIG. 2 is a perspective view showing a structure of a tunable band-pass filter of the first exemplary embodiment of the present invention.

Further, using FIG. 2, a tunable band-pass filter which can, in addition to the above effect, change a coupling amount between pieces of cavity resonator 20 is disclosed. A coupling amount or a coupling coefficient is related to a band of a band-pass filter, and when it is large, a band is wide, and, when it is small, a band is narrow. FIG. 2 indicates a structure in which a conductor 5*b* that is similar to the conductor 5 is also provided in a position corresponding to the window 21 between pieces of cavity resonator 20. Each piece of conductor 5 and a piece of conductor 5*b* are connected via a non-conductive member 6*b*.

The conductor 5*b* has a function to adjust a coupling amount between pieces of cavity resonator 20. That is, a coupling amount between pieces of cavity resonator 20 changes according to a resonance frequency of the cavity resonator 20 being changed by the conductor 5 provided above the resonant element 3. These pieces of conductor 5*b* do not need to be of an identical size and a shape among respective pieces of cavity resonator 20, and a size and a shape that are suitable for each of them can be selected.

Figure 6:
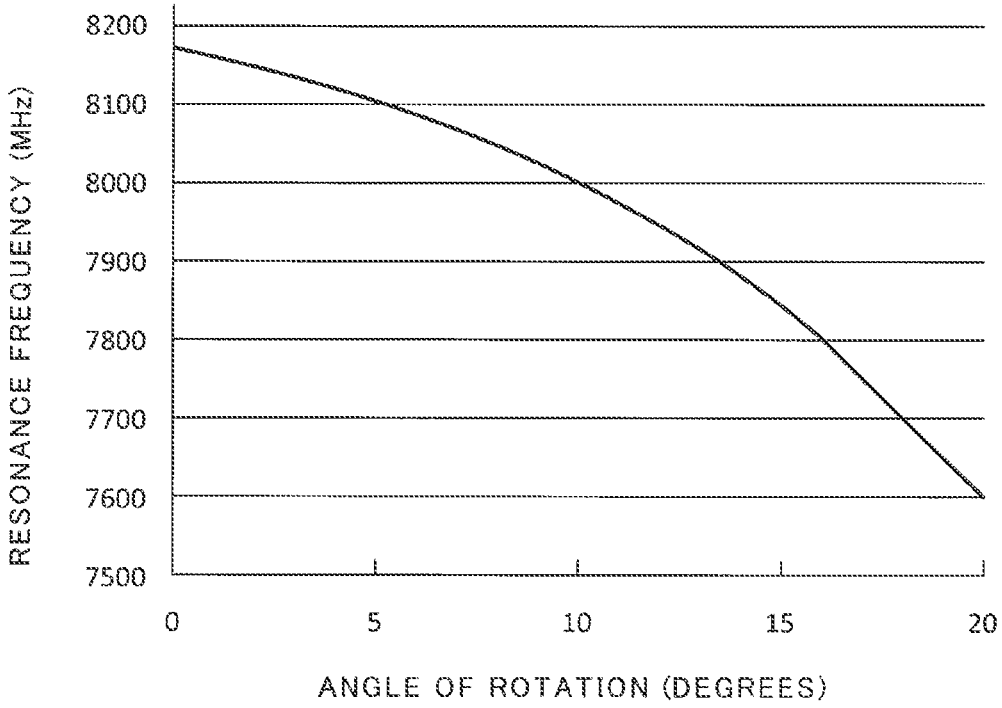
FIG. 6 is a diagram showing a change of a resonance frequency of a tunable band-pass filter of the first exemplary embodiment of the present invention.

Next, an effect in this exemplary embodiment will be described using FIG. 6. FIG. 6 indicates a state of a change in a resonance frequency of a band-pass filter of 8000 MHz band when, in the structure of FIG. 1A, rotating the conductor 5 in the downward direction of the arrow in the figure. At that time, the diameter of the cavity resonator 20 is 11 mm and the length 11 mm, and the width of the conductor 5 is 6 mm, the length 8 mm and the thickness 0.5 mm. The conductor 5 is in a position that is 8 mm from the bottom base of the cavity resonator 20, and the supporting point 12 of rotation is in a position that is offset from the center axis of the cavity resonator 20 by 3 mm. An inclined angle of 0 degree indicates a state that the conductor 5 is parallel to the conductive cover 2. By changing the angle of rotation from 0 degree to 15 degrees, a resonance frequency has declined by about 300 MHz. There are almost no return-loss deteriorations during that span.

As above, according to this exemplary embodiment, a tunable band-pass filter which is inexpensive and of a simple structure and which can change a resonance frequency of a cavity resonator and a coupling amount between cavity resonators easily can be provided.

Second Exemplary Embodiment

Figure 3A:
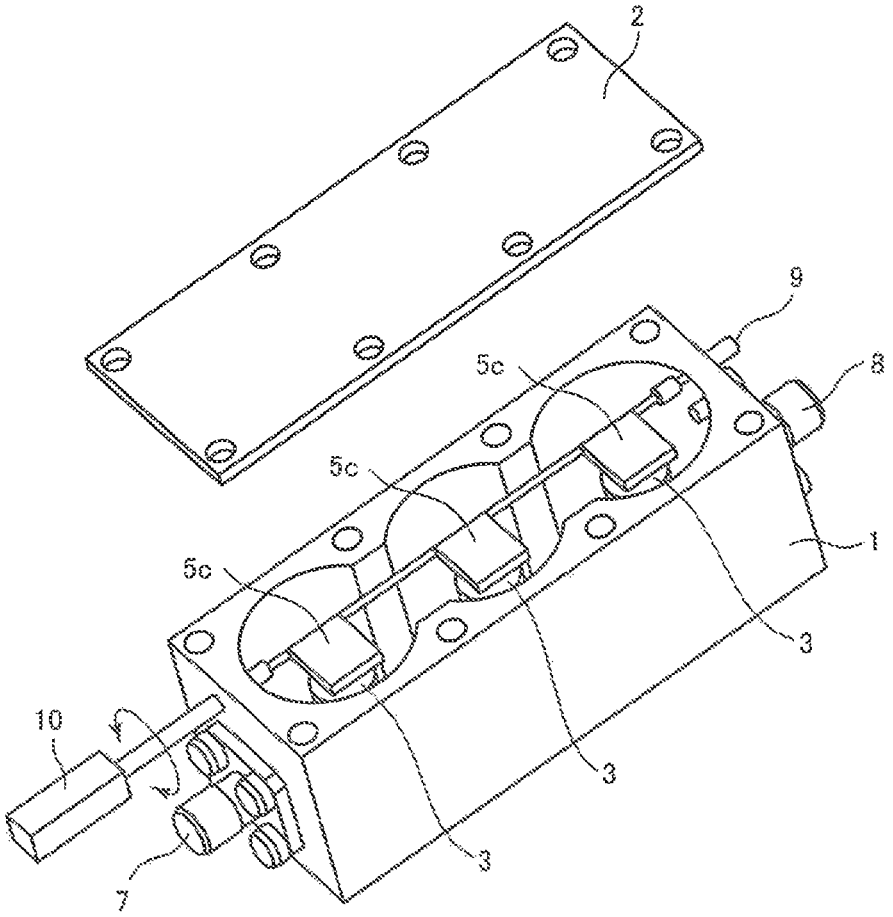
FIG. 3A is a perspective view showing a structure of a tunable band-pass filter of a second exemplary embodiment of the present invention.
Figure 3B:
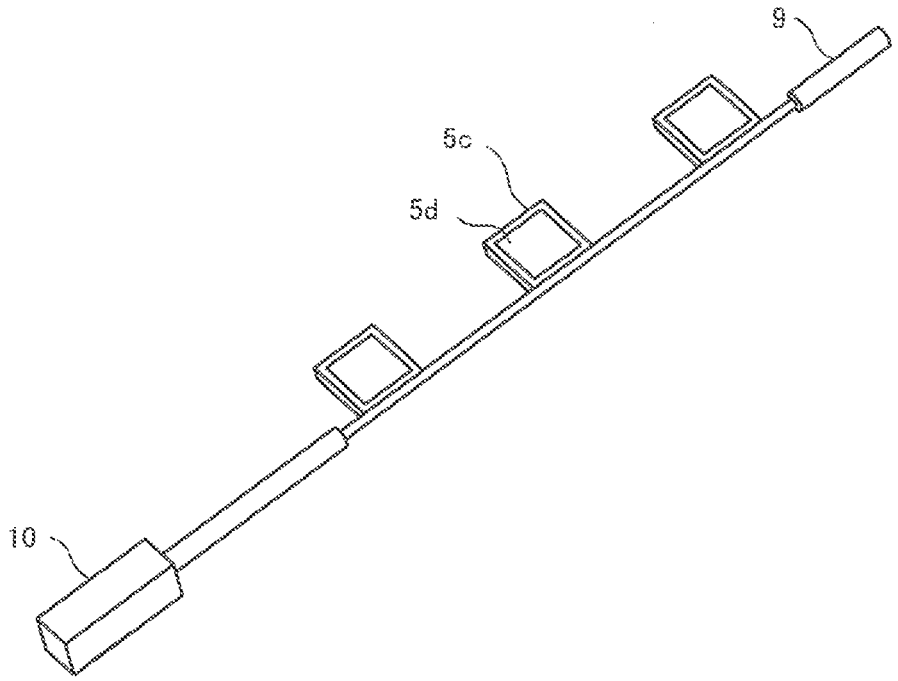
FIG. 3B is a perspective view showing a structure of a movable conductor part of the second exemplary embodiment of the present invention.

The second exemplary embodiment of the present invention will be described using FIG. 3A and FIG. 3B. FIG. 3A is a structure in which, in place of the conductor 5 of the first exemplary embodiment, a conductor 5*d* shown in FIG. 3B is formed on the face of a non-conductive member 5*c* in the side of the resonant element 3. FIG. 3B shows a conductor structure used in FIG. 3A. For example, a structure in which the conductor 5*d* made of a metallic film such as copper is formed on the non-conductive member 5*c* such as a printed wiring board can be used as a conductor. The conductor structure in which the conductor 5*d* is formed onto the non-conductive member 5*c* is connected by a connection member (no code attached in FIG. 3B) forming a rotating shaft.

The other components in this exemplary embodiment are the same as those of the first exemplary embodiment. That is, according to this exemplary embodiment, a tunable band-pass filter which is inexpensive and of a simple structure, and which can change a resonance frequency of a cavity resonator and a coupling amount between cavity resonators easily can be provided.

Third Exemplary Embodiment

Figure 4:
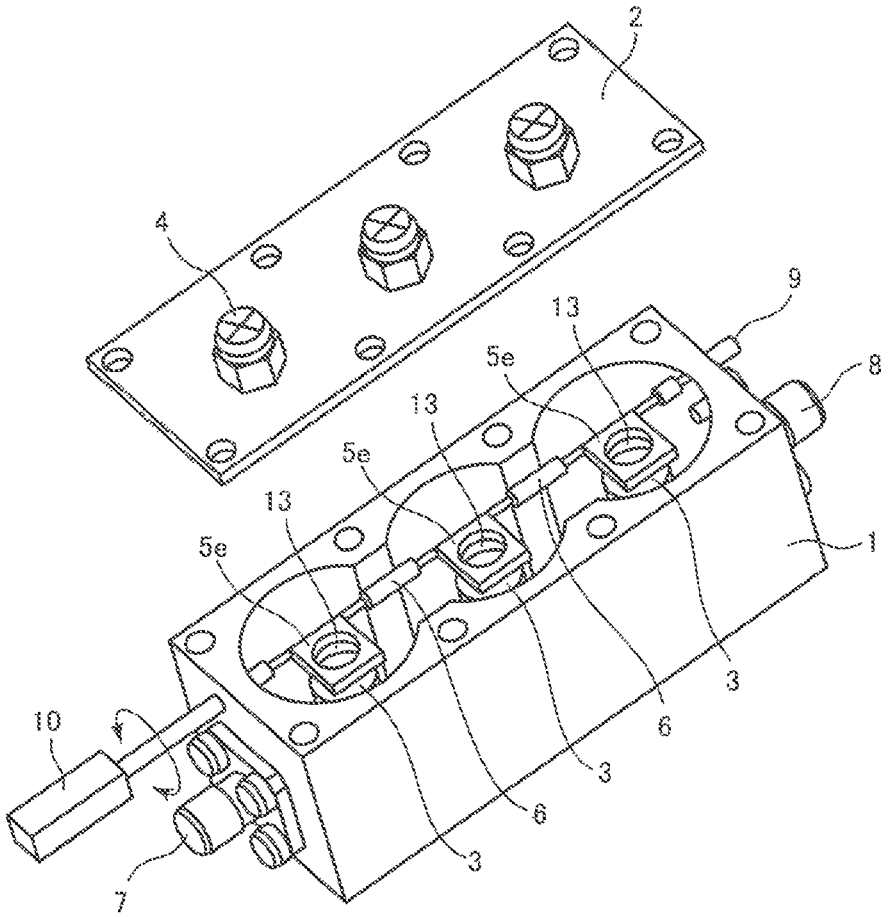
FIG. 4 is a perspective view showing a structure of a tunable band-pass filter of a third exemplary embodiment of the present invention.

The third exemplary embodiment of the present invention will be described using FIG. 4. FIG. 4 is a structure in which, in place of the conductor 5 of the first exemplary embodiment, a conductor 5*e* having a hole 13 which can let the frequency adjustment screw 4 through is provided. As a result, it also becomes possible to carry out frequency adjustment using the frequency adjustment screw 4 without influence of rotation of the conductor 5*e*, and thus a variable range of a resonance frequency as a band-pass filter can be expanded.

The other components of this exemplary embodiment are the same as those of the first exemplary embodiment. That is, according to this exemplary embodiment, a tunable band-pass filter which is inexpensive and of a simple structure and which can change a resonance frequency of a cavity resonator and a coupling amount between cavity resonators easily can be provided.

Fourth Exemplary Embodiment

Figure 5:
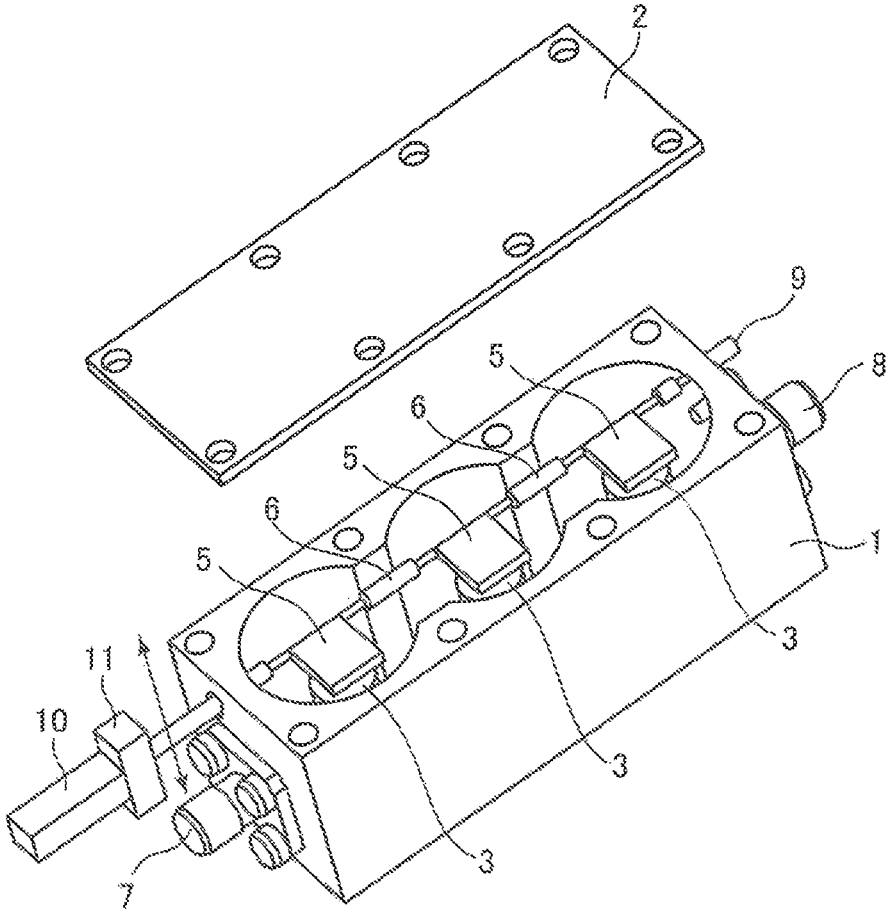
FIG. 5 is a perspective view showing a structure of a tunable band-pass filter of a fourth exemplary embodiment of the present invention.

The fourth exemplary embodiment of the present invention will be described using FIG. 5. FIG. 5 is a structure in which, in place of the rotating mechanism of the conductor 5 of the first exemplary embodiment, a rotational movement of a motor 10 is converted into an up and down movement by a gear 11 to make the conductor 5 move up and down. By moving it up and down, a resonance frequency can be changed by a distance between the conductor 5 and the resonant element 3 changing.

The other components of this exemplary embodiment are the same as those of the first exemplary embodiment. That is, according to this exemplary embodiment, a tunable band-pass filter which is inexpensive and of a simple structure and which can change a resonance frequency of a cavity resonator and a coupling amount between cavity resonators easily can be provided.

Various transformations are possible to the present invention within the scope of the invention described in the claims without limited to the above-mentioned exemplary embodiments, and it goes without saying that those are also included within the scope of the present invention. Part or all of the above-mentioned exemplary embodiments can also be described like the following supplementary notes, but not limited to them.

Supplementary Note (Supplementary Note 1)

A tunable band-pass filter, comprising: a conductive chassis having a cavity resonator; a conductive cover to cover said cavity resonator; a resonant element arranged in said cavity resonator, one end of said resonant element being connected with said chassis and an other end being open end; and a movable conductor arranged in a space between said open end of said resonant element and said conductive cover.

(Supplementary Note 2)

The tunable band-pass filter according to supplementary note 1, wherein there are a plurality of pieces of said cavity resonator, and said movable conductor is also deployed in a space between said cavity resonator and said cavity resonator.

(Supplementary Note 3)

The tunable band-pass filter according to any one of supplementary notes 1 to 2, wherein said movable conductor is connected by a non-conductivity material.

(Supplementary Note 4)

The tunable band-pass filter according to any one of supplementary notes 1 to 3, wherein movement of said movable conductor is a rotating movement.

(Supplementary Note 5)

The tunable band-pass filter according to any one of supplementary notes 1 to 3, wherein movement of said movable conductor is a linear movement.

(Supplementary Note 6)

The tunable band-pass filter according to any one of supplementary notes 1 to 5, having a frequency adjustment screw screwed in from said conductive cover in a manner facing said resonant element.

(Supplementary Note 7)

The tunable band-pass filter according to supplementary note 6, wherein said movable conductor has a hole corresponding to said frequency adjustment screw.

(Supplementary Note 8)

The tunable band-pass filter according to any one of supplementary notes 1 to 7, wherein said movable conductor is a non-conductivity material having a metallic film formed on said non-conductivity material.

(Supplementary Note 9)

The tunable band-pass filter according to any one of supplementary notes 1 to 8, wherein said resonant element is one of a conductor and a dielectric, having a shape selected from a tabular shape, a prismatic column and a circular cylinder.

(Supplementary Note 10)

The tunable band-pass filter according to any one of supplementary notes 1 to 9, wherein a source of power of said movable conductor is a motor.

(Supplementary Note 11)

The tunable band-pass filter according to supplementary note 10, wherein said motor is controlled by a computer.

This application claims priority based on Japanese application Japanese Patent Application No. 2012-233659 filed on Oct. 23, 2012, the disclosure of which is incorporated herein in its entirety.

INDUSTRIAL APPLICABILITY

The present invention relates to a band-pass filter used in a microwave and a millimeter wave, and, more particularly, to a tunable band-pass filter which can vary a resonance frequency.

REFERENCE SIGNS LIST

1 Conductive chassis
2 Conductive cover
3 Resonant element
4 Frequency adjustment screw
5, 5*b*, 5*d* and 5*e* Conductor
5*c* Non-conductive member
6 and 6*b* Non-conductive member
7 Input terminal
8 Output terminal
9 Support
10 Motor
11 Gear
12 Supporting point
13 Hole
20 Cavity resonator
21 Window

The invention claimed is:

1. A tunable band-pass filter, comprising:

a conductive chassis having a plurality of pieces of a cavity resonator;

a conductive cover to cover said plurality of pieces of the cavity resonator;

a plurality of resonant elements arranged in each said plurality of pieces of the cavity resonator, one end of said resonant elements being connected with said chassis and another end being an open end; and a plurality of movable conductors arranged in a space between said open end of said resonant elements and said conductive cover, wherein the plurality of movable conductors are in a space between pieces of the plurality of pieces of the cavity resonator, wherein the plurality of movable conductors are arranged above the plurality of resonant elements, wherein the plurality of movable conductor are between resonant elements, wherein the plurality of movable conductors move synchronously.

2. The tunable band-pass filter according to claim 1, wherein a source of power of said movable conductors is a motor.

3. The tunable band-pass filter according to claim 1, wherein each of said movable conductors is connected by a non-conductivity material.

4. The tunable band-pass filter according to claim 1, wherein movement of said movable conductors is a rotating movement.

5. The tunable band-pass filter according to claim 1, wherein movement of said movable conductors is a linear movement.

6. The tunable band-pass filter according to claim 1, having a frequency adjustment screw inserted in from said conductive cover in a manner facing at least one of said resonant elements.

7. The tunable band-pass filter according to claim 6, wherein at least one of said movable conductors has a hole corresponding to said frequency adjustment screw, wherein the frequency adjustment screw passes through the hole in the at least one of said movable conductors, wherein the at least one of said movable conductors rotates around an axis approximately perpendicular to an axis of the frequency adjustment screw.

8. The tunable band-pass filter according to claim 1, wherein each of said movable conductors is a non-conductivity material having a metallic film formed on said non-conductivity material.

9. The tunable band-pass filter according to claim 1, wherein each of said plurality of resonant elements is one of a conductor and a dielectric, having a shape selected from a tabular shape, a prismatic column and a circular cylinder.

10. A tunable band-pass filter, comprising:

a conductive chassis having a plurality of pieces of a cavity resonator;

a conductive cover to cover said plurality of pieces of the cavity resonator;

a resonant element arranged in said plurality of pieces of the cavity resonator, one end of each said resonant element being connected with said chassis and another end being an open end;

a movable conductor arranged in a space between said open end of said resonant element and said conductive cover; and a frequency adjustment screw inserted in from said conductive cover in a manner facing said resonant element, wherein said movable conductor has a hole corresponding to said frequency adjustment screw, wherein the frequency adjustment screw passes through the hole in the movable conductor, wherein the movable conductor rotates around an axis approximately perpendicular to an axis of the frequency adjustment screw.

11. The tunable band-pass filter according to claim 10, wherein said movable conductor is connected by a non-conductivity material.

12. The tunable band-pass filter according to claim 10, wherein movement of said movable conductor is a rotating movement.

13. The tunable band-pass filter according to claim 10, wherein movement of said movable conductor is a linear movement.

14. The tunable band-pass filter according to claim 10, wherein said movable conductor is a non-conductivity material having a metallic film formed on said non-conductivity material.

15. The tunable band-pass filter according to claim 10, wherein said resonant element is one of a conductor and a dielectric, having a shape selected from a tabular shape, a prismatic column, and a circular cylinder.

16. The tunable band-pass filter according to claim 10, wherein a source of power of said movable conductor is a motor.

* * * * *